US010349503B2

(12) United States Patent
Hogan et al.

(10) Patent No.: US 10,349,503 B2
(45) Date of Patent: Jul. 9, 2019

(54) LAMP DRIVER CARD TO CONTROL LIGHTING OF A LAMP LOAD OR A LED ON A WAYSIDE OF A RAILWAY SYSTEM

(71) Applicant: Siemens Industry, Inc., Alpharetta, GA (US)

(72) Inventors: Brian Joseph Hogan, Temecula, CA (US); Holger Schmidt, Saint Johns, FL (US)

(73) Assignee: SIEMENS MOBILITY, INC., New York, NY (US)

( * ) Notice: Subject to any disclaimer, the term of this patent is extended or adjusted under 35 U.S.C. 154(b) by 79 days.

(21) Appl. No.: 15/431,882

(22) Filed: Feb. 14, 2017

(65) Prior Publication Data

US 2018/0235054 A1 Aug. 16, 2018

(51) Int. Cl.

| | |
|---|---|
| ***B61L 7/10*** | (2006.01) |
| ***B61L 9/00*** | (2006.01) |
| ***H05B 37/03*** | (2006.01) |
| ***B61L 5/18*** | (2006.01) |

(52) U.S. Cl.

CPC ..... *H05B 37/03* (2013.01); *B61L 5/1881* (2013.01); *B61L 7/103* (2013.01); *B61L 2207/02* (2013.01)

(58) Field of Classification Search

None

See application file for complete search history.

(56) References Cited

U.S. PATENT DOCUMENTS

2017/0294126 A1* 10/2017 Russell, Jr. ..... H04R 1/028

* cited by examiner

*Primary Examiner* — Dedei K Hammond

(57) ABSTRACT

A lamp driver card to control lighting of a lamp load located on a wayside of a railway system is provided. The lamp driver card comprises a light source controller module including at least one channel having a semiconductor switch or a relay to receive power on a copper cable sized at a selected gauge size from a power source to turn ON or OFF the lamp load. The light source controller module is configured to support a multi-voltage rating range operation extended from a limited voltage to an extended operating voltage and a current rating to light the lamp load such that the light source controller module is compatible with relatively higher DC/AC voltages. The copper cable is sized at the selected gauge size of a first size to a second size based on a selected voltage rating of a first voltage system or a second multi-voltage ranges system.

20 Claims, 4 Drawing Sheets

LAMP DRIVER CARD TO CONTROL LIGHTING OF A LAMP LOAD OR A LED ON A WAYSIDE OF A RAILWAY SYSTEM

BACKGROUND

1. Field

Aspects of the present invention generally relate to controlling lighting of lamp loads or LEDs and more specifically relate to a lamp driver card for controlling lighting of lamp loads or LEDs on a wayside of a railway system.

2. Description of the Related Art

Lighting control systems are developed to control lighting of a lamp or a lamp array or a LED. Many of such control systems are designed to control the selection (on-off condition) of a given lamp or a LED. LEDs can replace the incandescent, halogen and fluorescent lamps in lighting applications. LEDs are about 50% more power efficient than incandescent and halogen lamps. An LED should be driven properly to emit desired light intensity in the correct wavelength, i.e., color. To provide the desired current we need to use a driver circuit with an LED. Likewise, a lamp or a lamp array may be driven by a lamp driver card which, in turn, is controlled by a microprocessor card. Power may be applied to the lamp from a power supply and the lamp driver card may include a power on/off switch.

Current DC signal lighting is implemented using a nominal 12 VDC battery voltage. Typical railroad wayside signals use incandescent light bulbs rated at 10V/18 W or 10V/25 W or LED modules with similar requirements. In order to limit the voltage drop over from the signal bungalow to the wayside signal, larger size and expensive copper cable sized at #9 AWG up to #6 AWG is being used. Current implementations of DC lamp drivers need to use copper cable sized at #9 AWG up to #6 AWG to limit the voltage drop to typically 1 to 2 volts max.

Railroads regularly already use 24V (28V) battery banks for switch machines. Other off the shelf battery systems (e.g. telecommunication systems) use 48 VDC. The higher DC voltage allows for a) smaller cable cross sections (such as #12 AWG or #14 AWG) or b) larger distances.

Therefore, there is a need for a DC lamp driver that is compatible with higher DC voltages and would support legacy 12V systems and newer 24V (or even 48V) systems.

SUMMARY

Briefly described, aspects of the present invention relate to a DC lamp driver card that is compatible with higher DC voltages (e.g., up to 60 VDC) and would allow for one and the same lamp module to support legacy 12V systems and newer 24V (or even 48V) systems. A DC lamp driver card supports DC voltages other than the typical 12 VDC (9.5 Vdc to 16.5V dc range) in conjunction with a railway freight system. This lamp module can provide up to 60 VDC on its output to drive higher voltage and wattage lamp loads and LED modules.

In accordance with one illustrative embodiment of the present invention, a DC lamp driver card to control lighting of a traffic signal lamp or a LED located on a wayside of a railway system is provided. The DC lamp driver card comprises a light source controller module including at least one channel having a semiconductor switch or a relay to receive power on a copper cable sized at a selected gauge size from a power source to turn ON or OFF the traffic signal lamp or the LED. The light source controller module to support a multi-voltage rating range operation extended from a limited voltage 12V DC (9.5V DC to 16.6 VDC) to an extended operating voltage 9.5V-60V DC and a 2.5 A current rating to light the traffic signal lamp or the LED of 18 W-25 W such that the light source controller module is compatible with relatively higher DC voltages. The copper cable is sized at the selected gauge size of #9 AWG or #6 AWG to #12 AWG or #14 AWG based on a selected voltage rating of a legacy 12V system or a newer 24V, 48V or 60V from the multi-voltage rating range operation.

In accordance with another illustrative embodiment of the present invention, a lamp driver card to control lighting of a lamp load located on a wayside of a railway system is provided. The lamp driver card comprises a light source controller module including at least one channel having a semiconductor switch or a relay to receive power on a cable sized at a selected gauge size from a power source to turn ON or OFF the lamp load. The light source controller module to support a multi-voltage rating range operation extended from a limited voltage to an extended operating voltage and a current rating to light the lamp load such that the light source controller module is compatible with relatively higher DC/AC voltages. The cable is sized at the selected gauge size of a first size to a second size based on a selected voltage rating of a first voltage system or a second multi-voltage ranges system.

In accordance with another illustrative embodiment of the present invention, a method of controlling lighting of a lamp load located on a wayside of a railway system is provided. The method comprises providing a light source controller module including at least one channel having a semiconductor switch or a relay. The method further comprises receiving power on a copper cable sized at a selected gauge size from a power source to turn ON or OFF the lamp load. The method further comprises supporting a multi-voltage rating range operation extended from a limited voltage to an extended operating voltage and a current rating to light the lamp load such that the light source controller module is compatible with relatively higher DC voltages. The method further comprises sizing the copper cable at the selected gauge size of a first size to a second size based on a selected voltage rating of a first voltage system or a second multi-voltage ranges system.

DETAILED DESCRIPTION

To facilitate an understanding of embodiments, principles, and features of the present invention, they are explained hereinafter with reference to implementation in illustrative embodiments. In particular, they are described in the context of being a wide voltage range lamp module. For example, 12V/24V/48V/60V outputs on one lamp module. Embodiments of the present invention, however, are not limited to use in the described devices or methods.

The components and materials described hereinafter as making up the various embodiments are intended to be illustrative and not restrictive. Many suitable components and materials that would perform the same or a similar function as the materials described herein are intended to be embraced within the scope of embodiments of the present invention.

Figure 1:
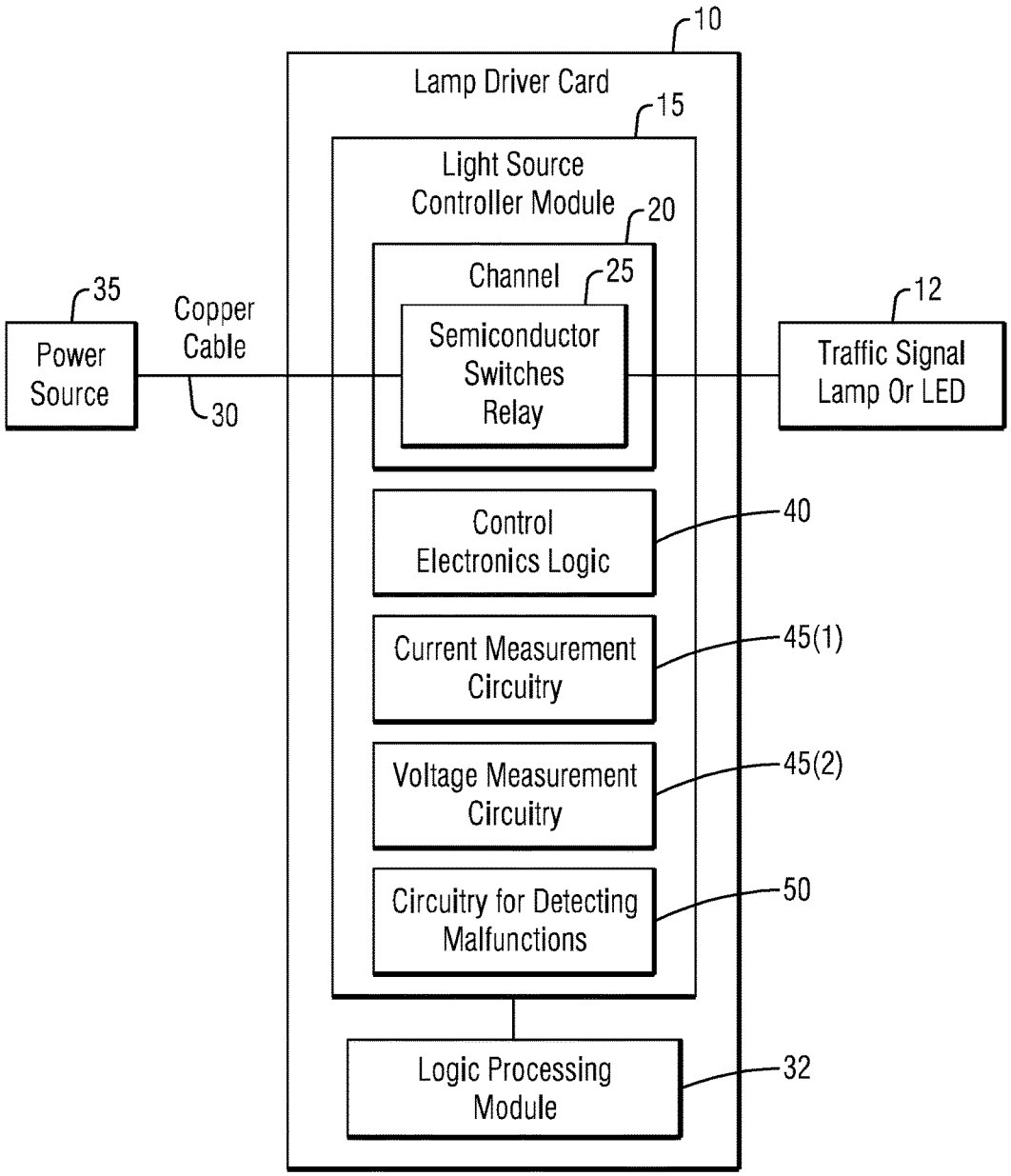
FIG. 1 illustrates a schematic block diagram of a lamp driver card in accordance with an exemplary embodiment of the present invention.

Consistent with one embodiment of the present invention, FIG. 1 represents a schematic block diagram of a lamp driver card 10 in accordance with an exemplary embodiment of the present invention. The lamp driver card 10 is configured to control lighting of a traffic signal lamp or a LED 12 located on a wayside of a railway system. The lamp driver card 10 comprises a light source controller module 15 including a channel 20 having a semiconductor switch 25 or a relay. For example, the semiconductor switch 25 is a wide voltage and current power field effect transistor (FET). A wayside railway system may include a traffic signal LED fixture and the lamp driver card 10 with a driver and a LED lamp module such as the light source controller module 15.

As used herein, "a light source controller module" refers to a lamp module configured to operate with a lamp driver. As used herein, "a channel" refers to a lamp driver. The "light source controller module," in addition to the exemplary hardware description above, refers to a system that is configured to provide a driver circuit. The driver circuit can include a wide voltage and current power field effect transistor (FET) and multiple interacting devices, whether located together or apart, that together perform processes as described herein.

The lamp driver card 10 is configured to receive power on a copper cable 30 sized at a selected gauge size from a power source 35 to turn ON or OFF the traffic signal lamp or the LED 12. The lamp driver card 10 further comprises a logic processing module 32 coupled to the light source controller module 15 to direct applying power to the traffic signal lamp or the LED 12. For example, the logic processing module 32 may be a microprocessor card.

The light source controller module 15 to support a multi-voltage rating range operation extended from a limited voltage 12V DC (9.5V DC to 16.6 VDC) to an extended operating voltage 9.5V-60V DC and a 2.5 A current rating to light the traffic signal lamp or the LED 12 of 18 W-25 W such that the light source controller module 15 is compatible with relatively higher DC voltages. The copper cable 30 is sized at the selected gauge size of #9 AWG or #6 AWG to #12 AWG or #14 AWG based on a selected voltage rating of a legacy 12V system or a newer 24V, 48V or 60V from the multi-voltage rating range operation.

The techniques described herein can be particularly useful for using a copper cable. While particular embodiments are described in terms of the copper cable 30, the techniques described herein are not limited to the copper cable but can also use other conductors such as aluminum, steel or metal alloys.

The light source controller module 15 may be a single lamp module that includes either 6 or 8 or 16 output channels 20. Each output channel 20 is optimized to drive the traffic signal lamp or the LED 12. Lighting control may be available through either single or multi-channel configuration. Each output channel 20 may deliver current to a lamp or a LED up to 2.5 A. The lamp driver card 10 may be a 16-channel constant current driver. The lamp driver card 10 as the 16-channel source driver may be useful for interfacing between low-level logic and high-current loads.

The light source controller module 15 further comprises a control electronics logic 40 to direct applying power to the traffic signal lamp or the LED 12. The light source controller module 15 further comprises current measurement circuitry 45(1) and voltage measurement circuitry 45(2) for a cold/hot filament detection. The light source controller module 15 further comprises circuitry 50 for detecting malfunctions with the traffic signal lamp or the LED 12, voltage regulation and over current limit.

Today high power LEDs of having 10-20 W (at 555 nm 1 W=683 lumens) of optical output powers are available on the market. These LEDs are being used in street lighting, automotive lighting, and traffic signalling applications. When used in such applications a number of LEDs are connected in series and parallel configurations to increase the total optical output power of the lamp, provide a reliable operation and extend the illuminated area.

The lamp driver card 10 may be designed such that it also prevents (to the extent possible) the traffic signal lamp or the LED 12 from heating and/or some cooling means should also be considered. In high power applications, the lamp driver card 10 may be an integrated circuit (IC) driver. For example, an IC LED driver may control the average LED forward current by switching generally a power metal-oxide semiconductor field effect transistor (MOSFET) to energize an inductor and transfer the energy stored into a capacitor when switched and ultimately transfer this energy to a LED array. Keeping LED's average current constant guarantees a constant optical power output. Arranging the level of the average current (dimming) is done by controlling the duty cycle of the switching. i.e., applying a pulse width modulation (PWM) signal to the gate of the power MOSFET with a relatively high frequencies (about 100 kHz).

High power LEDs could draw currents up to a few Amperes. Since generally a number of LEDs are used in designing a lamp the lamp driver card 10 is required to provide the total forward voltage and forward current at the same time. A lamp using LED as light source almost includes the LEDs and a proper driver circuit to provide the required voltage and the current needed by the LEDs.

Figure 2:
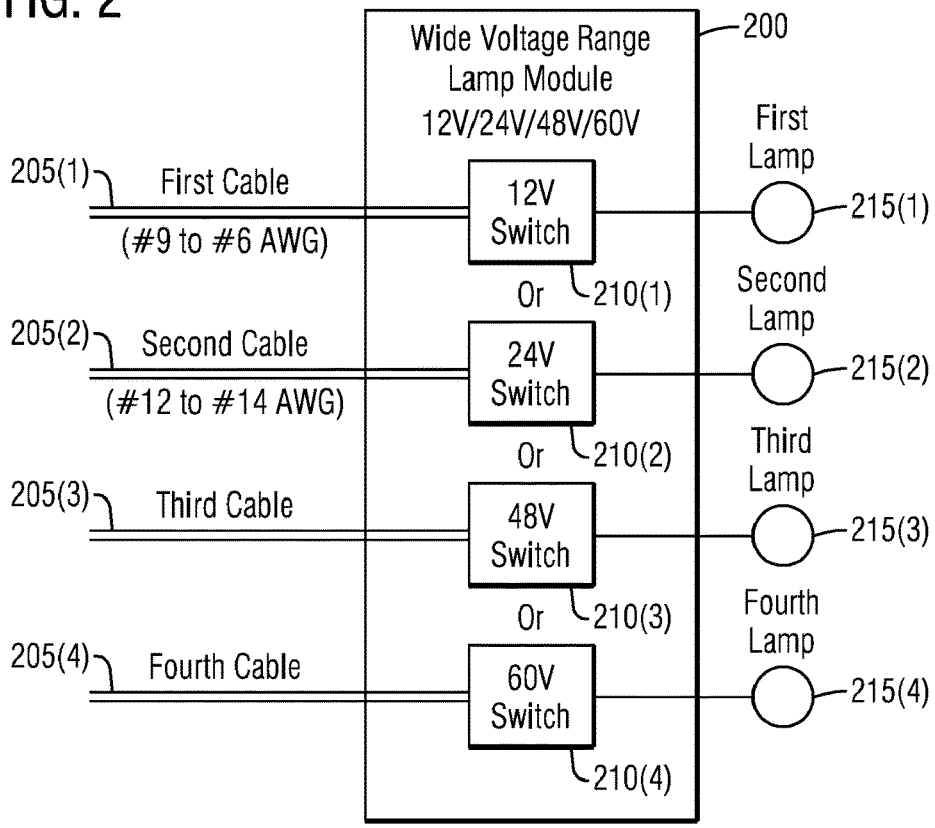
FIG. 2 illustrates a schematic block diagram of a wide voltage range lamp module in accordance with an exemplary embodiment of the present invention.

Referring to FIG. 2, it illustrates a schematic block diagram of a wide voltage range lamp module 200 in accordance with an exemplary embodiment of the present invention. The wide voltage range lamp module 200, for example, is a single or one lamp module that may be configured to operate at any one of all these 12V/24V/48V/60V voltages.

In one embodiment, a copper cable may be sized at a selected gauge size based on a selected voltage rating. For example, the selected gauge size may be #9 AWG or #6 AWG and #12 AWG or #14 AWG. Likewise, consistent with one embodiment, an Ampere current rating and a power wattage of a traffic signal lamp or a LED may be selected based on the selected voltage rating. For example, the current rating of the traffic signal lamp or the LED 12 may be 2.5 A and the power wattage may be 18 W-25 W.

A first copper cable 205(1) is sized at the selected gauge size of #9 AWG or #6 AWG and connected to a first switch 210(1) that is driving a first lamp 215(1) based on the selected voltage rating of a 12 VDC. A second copper cable 205(2) is sized at the selected gauge size of #12 AWG or #14 AWG and connected to a second switch 210(2) that is driving a second lamp 215(2) based on the selected voltage rating of a 24 VDC. A third copper cable 205(3) is sized at the selected gauge size and connected to a third switch 210(3) that is driving a third lamp 215(3) based on the selected voltage rating of a 48 VDC. A fourth copper cable 205(4) is sized at the selected gauge size and connected to a fourth switch 210(4) that is driving a third lamp 215(4) based on the selected voltage rating of a 60 VDC.

Figure 3:
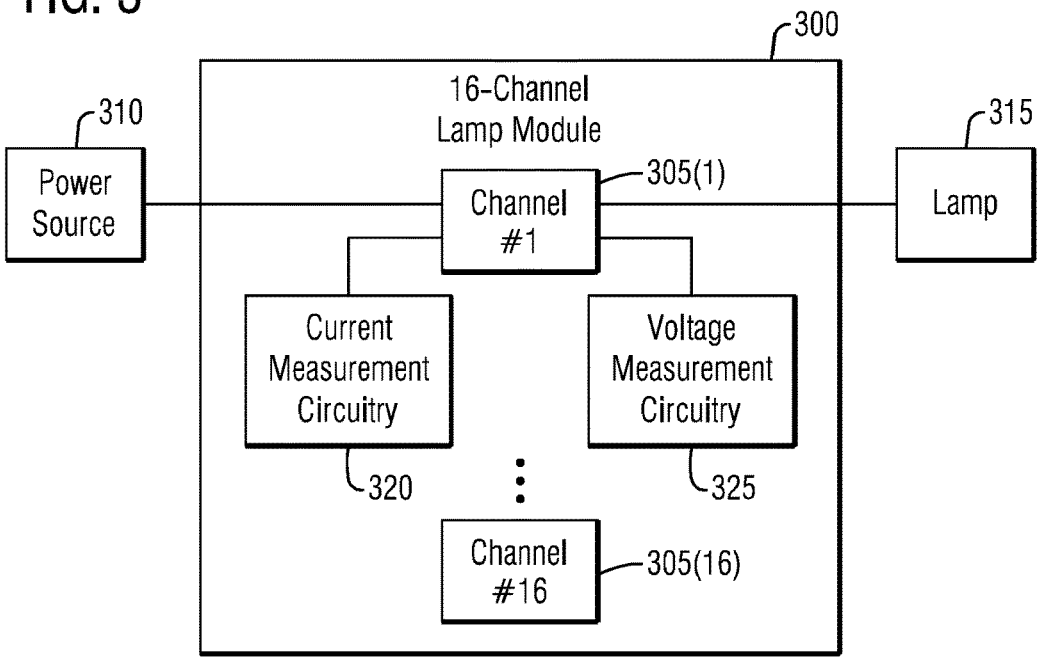
FIG. 3 illustrates a schematic block diagram of a 16-channel lamp module in accordance with another exemplary embodiment of the present invention.

Turning now to FIG. 3, it illustrates a schematic block diagram of a 16-channel lamp module 300 in accordance with another exemplary embodiment of the present invention. The 16-channel lamp module 300 includes 16 channels 305(1-16) or lamp drivers. In particular, the channel #1 305(1) may receive power from a power source 310 and light a lamp 315. The channel #1 305(1) has a current measurement circuitry 320 and a voltage measurement circuitry 325 associated therewith.

Figure 4:
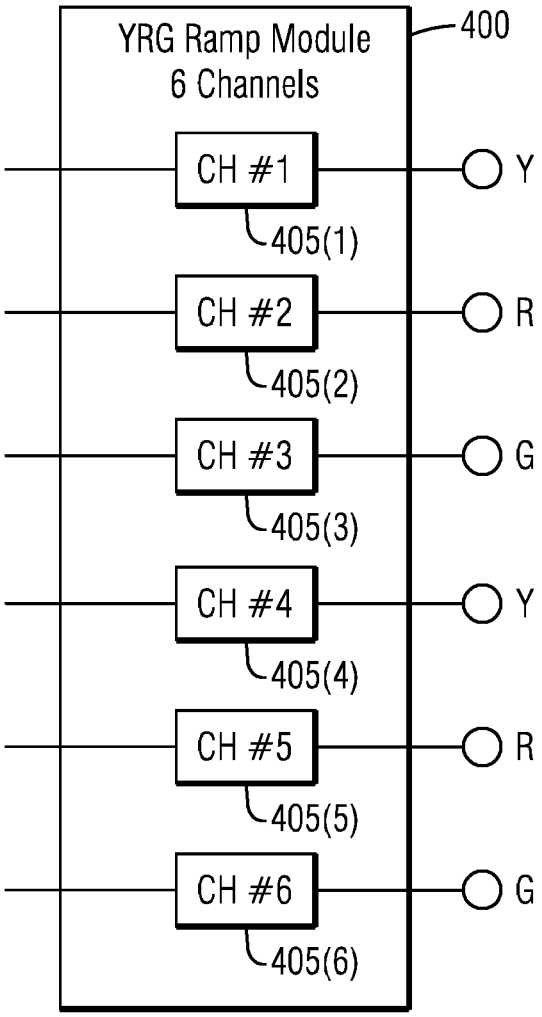
FIG. 4 illustrates a schematic block diagram of a 6-channel YRG lamp module in accordance with another exemplary embodiment of the present invention.

FIG. 4 illustrates a schematic block diagram of a 6-channel YRG lamp module 400 in accordance with another exemplary embodiment of the present invention. The 6-channel YRG lamp module 400 includes 6 channels 405(1-6) or lamp drivers. In particular, the channels #1-#3 405(1-3) may form a first traffic signal of yellow (Y), red (R) and green (G) on a wayside of a railway system. The channels #4-#6 405(4-6) may form a second traffic signal of yellow (Y), red (R) and green (G) on the wayside of the railway system.

Figure 5:
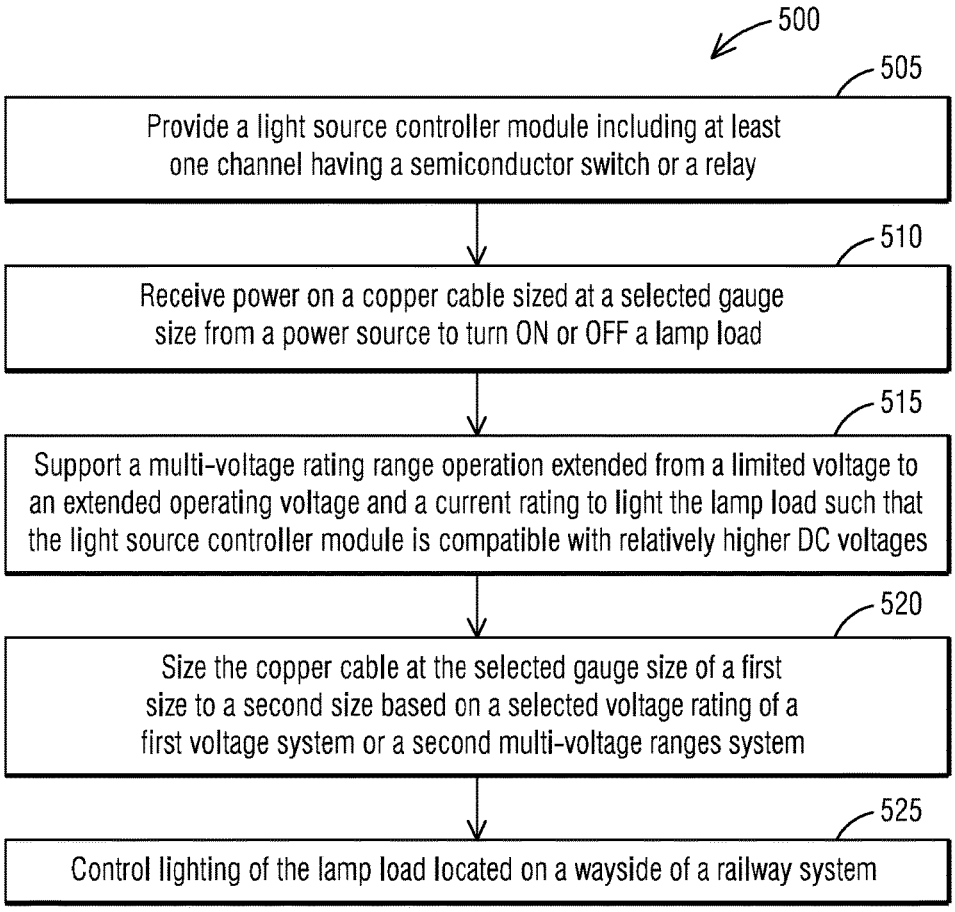
FIG. 5 illustrates a flow chart of a method of controlling lighting of a lamp load located on a wayside of a railway system according to an exemplary embodiment of the present invention.

FIG. 5 illustrates a flow chart of a method 500 of controlling lighting of a lamp load located on a wayside of a railway system according to an exemplary embodiment of the present invention. Reference is made to the elements and features described in FIGS. 1-4. It should be appreciated that some steps are not required to be performed in any particular order, and that some steps are optional.

The method 500, in step 505, includes providing the light source controller module 15 including at least one channel having a semiconductor switch or a relay. The method 500, in step 510, includes receiving power on a copper cable sized at a selected gauge size from a power source to turn ON or OFF the lamp load. The method 500, in step 515, includes supporting a multi-voltage rating range operation extended from a limited voltage to an extended operating voltage and a current rating to light the lamp load such that the light source controller module is compatible with relatively higher DC voltages.

The method 500, in step 520, includes sizing the copper cable at the selected gauge size of a first size to a second size based on a selected voltage rating of a first voltage system or a second multi-voltage ranges system. The method 500, in step 525, includes controlling lighting of a lamp load located on a wayside of a railway system.

The light source controller module 15 may provide real-time general purpose light controlling for a wide range of functions associated with railroad wayside and grade crossing installations for a wide range of input voltages. The light source controller module 15 may support a multi-voltage rating range operation extended from a limited voltage to an extended operating voltage and a current rating to light the lamp load such that the light source controller module 15 is compatible with relatively higher DC/AC voltages. For example, the light source controller module 15 to support a multi-voltage rating range operation extended from the limited voltage of 12V DC (9.5V DC to 16.6 VDC).

In one embodiment, the light source controller module 15 to support a multi-voltage rating range operation extended from the limited voltage to an extended operating voltage of 9.5V-60V DC. The copper cable 30 is sized at the selected gauge size of a first size to a second size based on a selected voltage rating of a first voltage system (e.g., 12 VDC legacy system) or a second multi-voltage ranges system (12 VDC-60 VDC extended system).

In the above description, both the use of DC and AC systems is contemplated. Also an AC or DC (e.g. AC/DC) besides a DC only or an AC only product is also possible.

While embodiments of the present invention have been disclosed in exemplary forms, it will be apparent to those skilled in the art that many modifications, additions, and deletions can be made therein without departing from the spirit and scope of the invention and its equivalents, as set forth in the following claims.

Embodiments and the various features and advantageous details thereof are explained more fully with reference to the non-limiting embodiments that are illustrated in the accompanying drawings and detailed in the following description. Descriptions of well-known starting materials, processing techniques, components and equipment are omitted so as not to unnecessarily obscure embodiments in detail. It should be understood, however, that the detailed description and the specific examples, while indicating preferred embodiments, are given by way of illustration only and not by way of limitation. Various substitutions, modifications, additions and/or rearrangements within the spirit and/or scope of the underlying inventive concept will become apparent to those skilled in the art from this disclosure.

As used herein, the terms "comprises," "comprising," "includes," "including," "has," "having" or any other variation thereof, are intended to cover a non-exclusive inclusion. For example, a process, article, or apparatus that comprises a list of elements is not necessarily limited to only those elements but may include other elements not expressly listed or inherent to such process, article, or apparatus.

Additionally, any examples or illustrations given herein are not to be regarded in any way as restrictions on, limits to, or express definitions of, any term or terms with which they are utilized. Instead, these examples or illustrations are to be regarded as being described with respect to one particular embodiment and as illustrative only. Those of ordinary skill in the art will appreciate that any term or terms with which these examples or illustrations are utilized will encompass other embodiments which may or may not be given therewith or elsewhere in the specification and all such embodiments are intended to be included within the scope of that term or terms.

In the foregoing specification, the invention has been described with reference to specific embodiments. However, one of ordinary skill in the art appreciates that various modifications and changes can be made without departing from the scope of the invention. Accordingly, the specification and figures are to be regarded in an illustrative rather than a restrictive sense, and all such modifications are intended to be included within the scope of invention.

Although the invention has been described with respect to specific embodiments thereof, these embodiments are merely illustrative, and not restrictive of the invention. The description herein of illustrated embodiments of the invention is not intended to be exhaustive or to limit the invention to the precise forms disclosed herein (and in particular, the inclusion of any particular embodiment, feature or function is not intended to limit the scope of the invention to such embodiment, feature or function). Rather, the description is intended to describe illustrative embodiments, features and functions in order to provide a person of ordinary skill in the art context to understand the invention without limiting the invention to any particularly described embodiment, feature or function. While specific embodiments of, and examples for, the invention are described herein for illustrative purposes only, various equivalent modifications are possible within the spirit and scope of the invention, as those skilled in the relevant art will recognize and appreciate. As indicated, these modifications may be made to the invention in light of the foregoing description of illustrated embodiments of the invention and are to be included within the spirit and scope of the invention. Thus, while the invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the invention.

Respective appearances of the phrases "in one embodiment," "in an embodiment," or "in a specific embodiment" or similar terminology in various places throughout this specification are not necessarily referring to the same embodiment. Furthermore, the particular features, structures, or characteristics of any particular embodiment may be combined in any suitable manner with one or more other embodiments. It is to be understood that other variations and modifications of the embodiments described and illustrated herein are possible in light of the teachings herein and are to be considered as part of the spirit and scope of the invention.

In the description herein, numerous specific details are provided, such as examples of components and/or methods, to provide a thorough understanding of embodiments of the invention. One skilled in the relevant art will recognize, however, that an embodiment may be able to be practiced without one or more of the specific details, or with other apparatus, systems, assemblies, methods, components, materials, parts, and/or the like. In other instances, well-known structures, components, systems, materials, or operations are not specifically shown or described in detail to avoid obscuring aspects of embodiments of the invention. While the invention may be illustrated by using a particular embodiment, this is not and does not limit the invention to any particular embodiment and a person of ordinary skill in the art will recognize that additional embodiments are readily understandable and are a part of this invention.

It will also be appreciated that one or more of the elements depicted in the drawings/figures can also be implemented in a more separated or integrated manner, or even removed or rendered as inoperable in certain cases, as is useful in accordance with a particular application.

Benefits, other advantages, and solutions to problems have been described above with regard to specific embodiments. However, the benefits, advantages, solutions to problems, and any component(s) that may cause any benefit, advantage, or solution to occur or become more pronounced are not to be construed as a critical, required, or essential feature or component.

What is claimed is:

1. A DC lamp driver card to control lighting of a traffic signal lamp or a LED located on a wayside of a railway system, the DC lamp driver card comprising:

a light source controller module including at least one channel having a semiconductor switch or a relay to receive power on a copper cable sized at a selected gauge size from a power source to turn ON or OFF the traffic signal lamp or the LED, wherein the light source controller module is configured to support a multi-voltage rating range operation extended from a limited voltage 12V DC (9.5V DC to 16.6 VDC) to an extended operating voltage 9.5V-60V DC and a 2.5 A current rating to light the traffic signal lamp or the LED of 18 W 25 W such that the light source controller module is compatible with higher DC voltages of 24V, 48V or 60V, wherein the copper cable is sized at the selected gauge size of #9 AWG or #6 AWG to #12 AWG or #14 AWG based on a selected voltage rating of a legacy 12V system or a newer 24V, 48V or 60V from the multi-voltage rating range operation.

2. The DC lamp driver card of claim 1, wherein the light source controller module is a single lamp module that includes either 6 or 8 or 16 channels.

3. The DC lamp driver card of claim 1, wherein the semiconductor switch is a wide voltage and current power field effect transistor (FET).

4. The DC lamp driver card of claim 1, wherein the light source controller module further comprises:

a control electronics logic to direct applying power to the traffic signal lamp or the LED.

5. The DC lamp driver card of claim 1, further comprising:

a logic processing module coupled to the light source controller module to direct applying power to the traffic signal lamp or the LED.

6. The DC lamp driver card of claim 1, wherein the light source controller module further comprises:

current measurement circuitry and voltage measurement circuitry for a cold/hot filament detection.

7. The DC lamp driver card of claim 1, wherein the light source controller module further comprises:

circuitry for detecting voltage regulation and over current limit malfunctions with the traffic signal lamp or the LED.

8. A lamp driver card to control lighting of a lamp load located on a wayside of a railway system, the lamp driver card comprising:

a light source controller module including at least one channel having a semiconductor switch or a relay to receive power on a cable sized at a selected gauge size from a power source to turn ON or OFF the lamp load, wherein the light source controller module is configured to support a multi-voltage rating range operation extended from a limited voltage to an extended operating voltage and a current rating to light the lamp load such that the light source controller module is compatible with DC/AC voltages higher than the limited voltage, wherein the cable is sized at the selected gauge size of a first size to a second size based on a selected voltage rating of a first voltage system or a second multi-voltage ranges system.

9. The lamp driver card of claim 8, wherein the light source controller module is a single lamp module that includes either 6 or 8 or 16 channels.

10. The lamp driver card of claim 8, wherein the semiconductor switch is a wide voltage and current power field effect transistor (FET).

11. The lamp driver card of claim 8, wherein the light source controller module further comprises:

a control electronics logic to direct applying power to the traffic signal lamp or the LED.

12. The lamp driver card of claim 8, further comprising:

a logic processing module coupled to the light source controller module to direct applying power to the traffic signal lamp or the LED.

13. The lamp driver card of claim 8, wherein the light source controller module further comprises:

current measurement circuitry and voltage measurement circuitry for a cold/hot filament detection.

14. The lamp driver card of claim 8, wherein the light source controller module further comprises:

circuitry for detecting voltage regulation and over current limit malfunctions with the traffic signal lamp or the LED.

15. The lamp driver card of claim 8, wherein the cable is sized at the selected gauge size of the first size of #9 AWG or #6 AWG.

16. The lamp driver card of claim 8, wherein the cable is sized at the selected gauge size of the second size of #12 AWG or #14 AWG.

17. The lamp driver card of claim 8, wherein the light source controller module is configured to support a multi-voltage rating range operation extended from the limited voltage of 12V DC (9.5V DC to 16.6 VDC).

18. The lamp driver card of claim 8, wherein the light source controller module is configured to support a multi-voltage rating range operation extended from the limited voltage to an extended operating voltage of 9.5V-60V DC.

19. A method of controlling lighting of a lamp load located on a wayside of a railway system, the method comprising:

providing a light source controller module including at least one channel having a semiconductor switch or a relay;

receiving power on a copper cable sized at a selected gauge size from a power source to turn ON or OFF the lamp load;

supporting a multi-voltage rating range operation extended from a limited voltage to an extended operating voltage and a current rating to light the lamp load such that the light source controller module is compatible with DC voltages higher than the limited voltage; and sizing the copper cable at the selected gauge size of a first size to a second size based on a selected voltage rating of a first voltage system or a second multi-voltage ranges system.

20. The method of claim 19, wherein the light source controller module is a single lamp module that includes either 6 or 8 or 16 channels.

* * * * *